US007719478B2

(12) United States Patent
Boisbouvier et al.

(10) Patent No.: US 7,719,478 B2
(45) Date of Patent: May 18, 2010

(54) OPTIMISATION OF FORBIDDEN PHOTO BAND ANTENNAE

(75) Inventors: Nicolas Boisbouvier, Evian les Bains (FR); Ali Louzir, Rennes (FR); Françoise Le Bolzer, Rennes (FR); Anne-Claude Tarot, Etrelles (FR); Kouroch Mahdjoubi, Cesson Sevigne (FR)

(73) Assignee: Thomson Licensing, Boulogne-Billancourt (FR)

( * ) Notice: Subject to any disclaimer, the term of this patent is extended or adjusted under 35 U.S.C. 154(b) by 173 days.

(21) Appl. No.: 11/791,691

(22) PCT Filed: Nov. 24, 2005

(86) PCT No.: PCT/FR2005/050985

§ 371 (c)(1),
(2), (4) Date: May 24, 2007

(87) PCT Pub. No.: WO2006/064140

PCT Pub. Date: Jun. 22, 2006

(65) Prior Publication Data

US 2008/0191962 A1 Aug. 14, 2008

(30) Foreign Application Priority Data

Dec. 13, 2004 (FR) ..... 04 52947

(51) Int. Cl.
*H01Q 19/00* (2006.01)
*H01Q 19/10* (2006.01)

(52) U.S. Cl. ..... 343/833; 343/834; 343/837

(58) Field of Classification Search ..... 343/909, 343/795, 773, 815, 833, 834, 893
See application file for complete search history.

(56) References Cited

U.S. PATENT DOCUMENTS

| | | | | |
|---|---|---|---|---|
| 4,700,197 | A | 10/1987 | Milne | |
| 5,689,275 | A * | 11/1997 | Moore et al. | 343/786 |
| 6,483,640 | B1 | 11/2002 | Tonucci et al. | |
| 7,117,133 | B2 * | 10/2006 | Chen et al. | 703/2 |
| 7,636,070 | B2 * | 12/2009 | De Lustrac et al. | 343/909 |
| 2004/0041741 | A1 | 3/2004 | Hayes | |

OTHER PUBLICATIONS

G. Poilasne et al.: "Metallic Photonic Band-Gap Materials (MPBG) as Angular Selective Reflector or Radome: Application to Antenna Grating Lobe Reduction", Annals of Telecommunications, vol. 55, No. 5/6, May 2000, pp. 207-215.
Search Report Dated Mar. 7, 2006.

* cited by examiner

*Primary Examiner*—Michael C Wimer
*Assistant Examiner*—Kyana R Robinson
(74) *Attorney, Agent, or Firm*—Robert D. Shedd; Jeffrey M. Navon

(57) ABSTRACT

The present invention relates to photonic band gap antennas. This antenna comprises according to a plane of directions x, y, a radiating source and a photonic band gap structure constituted by parallel metal rods, the rods repeating themselves nx times in the direction x and ny times in the direction y. The height of the rods seen from the radiating source is increasing. The invention is able to control the radiation pattern of the antenna in the vertical plane.

11 Claims, 2 Drawing Sheets

A

B

OPTIMISATION OF FORBIDDEN PHOTO BAND ANTENNAE

This application claims the benefit, under 35 U.S.C. §365 of International Application PCT/FR2005/050985, filed Nov. 24, 2005, which was published in accordance with PCT Article 21(2) on Jun. 22, 2006 in French and which claims the benefit of French patent application No. 0452947, filed on Dec. 13, 2004.

The present invention relates to photonic band gap antennas.

The photonic band gap structures (known as PBG structure) are periodic structures that prohibit wave propagation for certain frequency bandwidths. The structures were first used in the optical field but, in recent years, their application has extended to other frequency ranges. Photonic band gap structures are notably used in microwave devices such as filters, antennas or similar devices.

Among the photonic band gap structures, we find metal structures that use a periodic distribution of metallic elements, others a periodic distribution of dielectric elements but also metal-dielectric structures.

The present invention relates to a photonic band gap structure using metal elements, more particularly parallel rods perfectly conducting and arranged periodically.

Photonic band gap antennas using metal elements such as parallel metal rods have already been studied. Hence, the article published in the Chin. Phys. Lett. Vol. 19, no. 6 (2002) 804 entitled "Metal Photonic Band Gap Resonant Antenna with High Directivity and High Radiation Resistance", by Lin Qien, FU-Jian, HE Sai-Ling, Zhang Jian-Wu studies a metal photonic band gap resonant structure (MPBG) formed by infinitely long parallel metal rods according to the direction Z.

This article more particularly studies the directivity and radiation resistance for a certain frequency range of a resonant antenna (MPBG) comprising a linear radiation source antenna and a cavity constructed in a metal photonic structure formed by parallel metal rods, the cavity being obtained by eliminating some rods around the source antenna. Studies on the photonic band gap antennas of this type have been conducted with infinite metal rods or assumed to be infinite.

The present invention relates to a photonic band gap (PBG) antenna that is realized by metal rods of finite length, the height of the rods with respect to the substrate receiving the radiating source being controlled so as to control the radiation pattern of the antenna in the vertical plane.

The present invention relates to a photonic band gap (PBG) antenna comprising, according to a plane of directions x, y, a radiating source and a photonic band gap structure constituted by parallel metal rods, perpendicular to the plane, the rods of diameter d repeating themselves $n_x$ times with a period $a_x$ in the direction x and $n_y$ times with a period $a_y$ in the direction y, characterized in that the height of the rods seen from the radiating source is increasing.

According to a preferential embodiment, the height of the rods between the source and the outermost rod is chosen to be greater than kh/n, n being equal to the number of rods seen from the source, h being the height of the outermost rod and k an integer varying between 1 and n.

Preferably, the height of the first metal rods seen by the source is chosen to be greater than 3×l where l is the height of the radiating source. At this value, the MPBG effect is obtained, namely, bandwidth and band gaps are obtained depending on the period at a given frequency.

Preferably, the heights of the rods between the source and the outermost rod follow an increasing monotonic function.

Preferably, according to each direction x or y, the numbers of rods are identical. They are chosen such that n≧3. However, the numbers of rods seen from the source can be different, which gives numbers nx and ny of rods having different values.

According to a preferential characteristic of the present invention, the periods $a_x$ and $a_y$ of reproduction of the metal rods according to the directions x and y are chosen to be identical. However, these periods $a_x$ and $a_y$ can be different.

According to an embodiment of the present invention, the rods are produced in a metallic material having a conductivity greater than $10^{-7}$ such as copper ($5.9.10^7$ S/m), silver ($4.1.10^7$ S/m), aluminium ($3.5.10^7$ S/m) or similar.

On the other hand, the source is constituted by a dipole or a vertical monopole fixed to the substrate forming a ground plane. The said source is positioned in the place of one of the metal rods or between the metal rods.

Other characteristics and advantages of the present invention will emerge upon reading the description of different preferential embodiments, this description being made with reference to the drawings attached in the appendix, in which:

FIG. 1 diagrammatically shows, at A a photonic band gap antenna in which the rods are of the same height h (h=8l, where l height of the source) and at B, a radiation pattern according to the three axes x, y, z.

Figure 4:
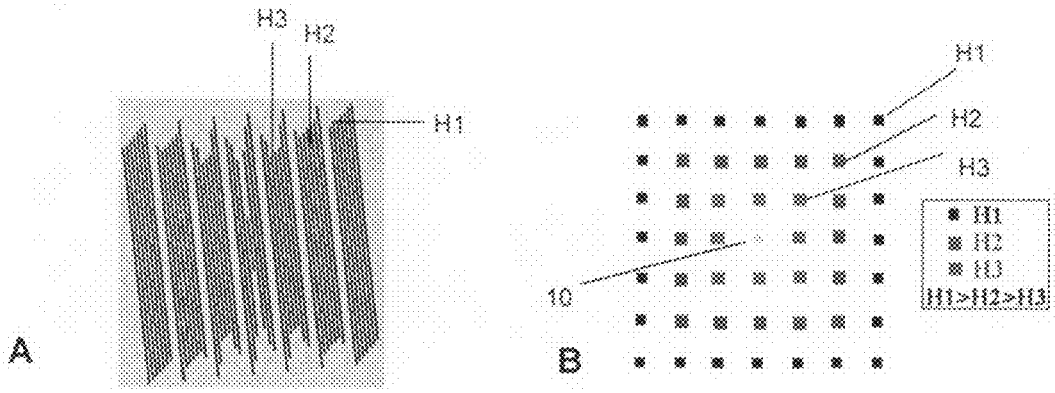
Figure 5:
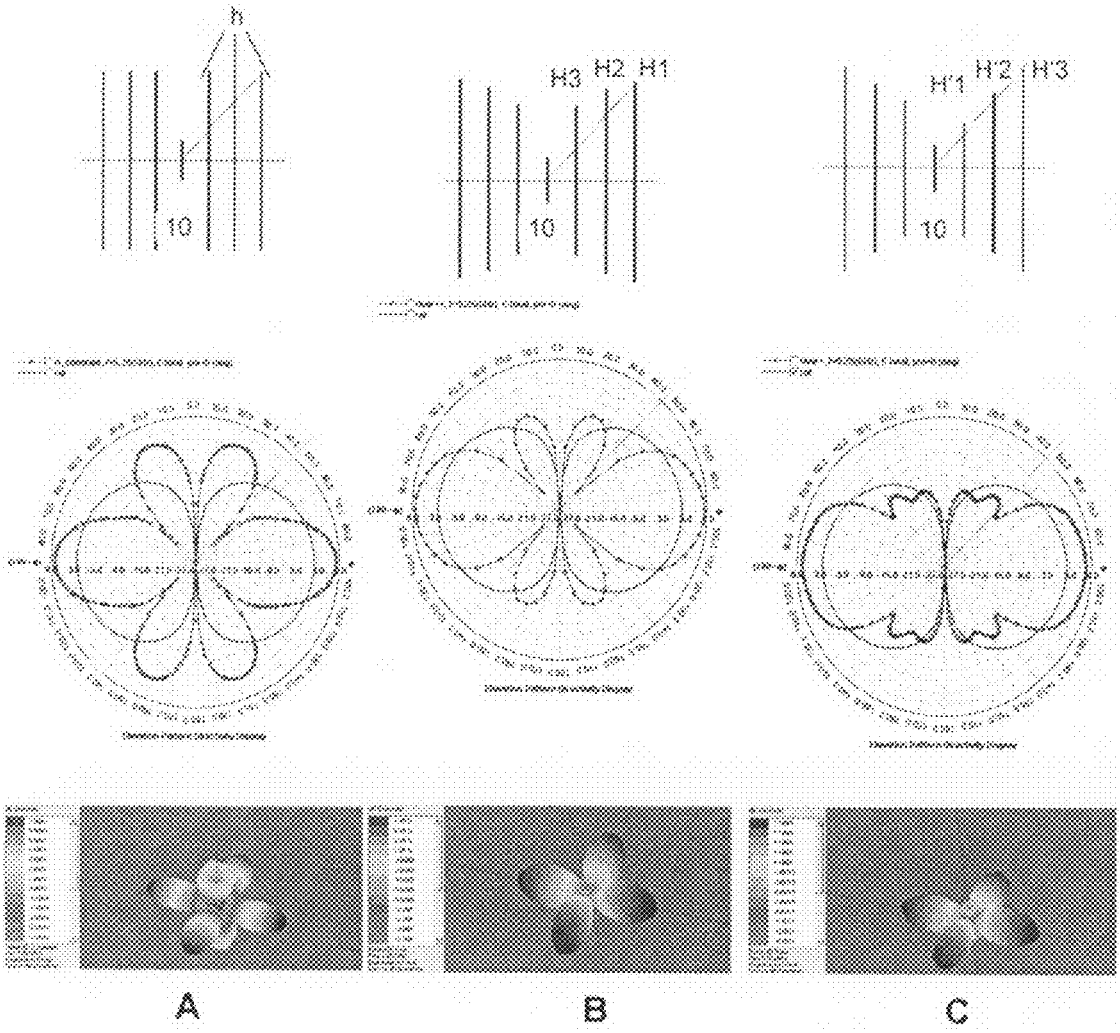

FIG. 4 diagrammatically shows at A a 3D view and at B a top view of a photonic band gap antenna, in accordance with an embodiment of the present invention, and FIG. 5 shows three configurations of photonic band gap antennas with metal rods of different heights according to the views with, for each configuration, an elevation radiation pattern and a 3D radiation pattern.

The examples described below are non-restrictive diagrammatic embodiments. These embodiments were used to test the feasibility and the results obtained with the structure in accordance with the invention. However, in a practical embodiment, a monopole would preferably be used on a ground plane with the rod themselves also fixed to the said plane, rather than a dipole.

Figure 1:
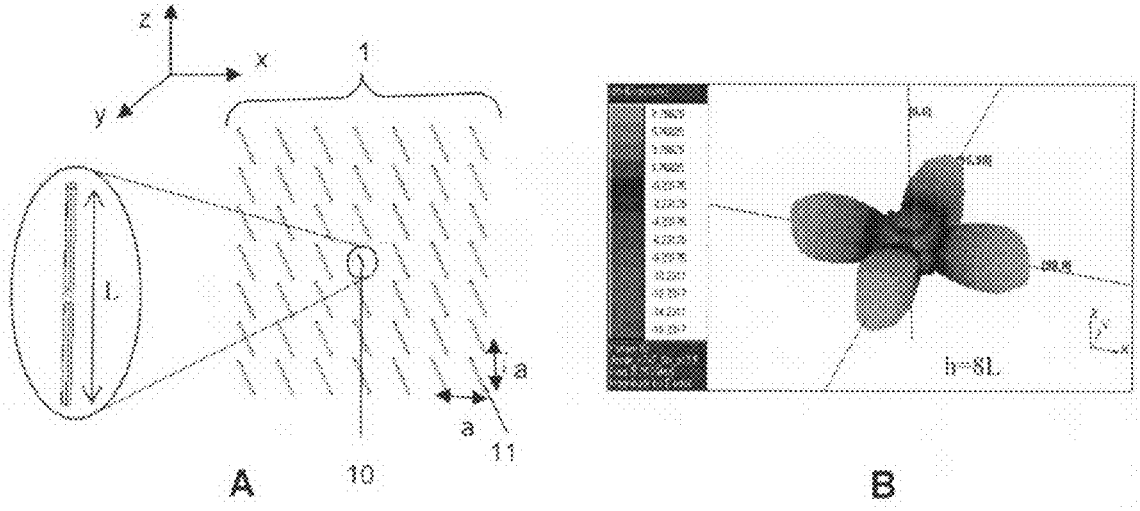

FIG. 1 shows an antenna 1 constituted by a dipole 10, positioned in the middle of a photonic band gap (PBG) structure, formed by metal rods 11 of finite height (referenced as MPBG structure). The metal rods are made of a material having a conductivity greater than $10^{-7}$ such as copper, silver, aluminium or similar.

As shown in FIG. 1, the metal rods 11 are arranged according to 7 rows of 7 elements, the rows and elements being spaced from each other at the distance a giving the step or period of the photonic band gap structure.

In the embodiment shown in FIG. 1, the MPBG structure has the form of square pattern where $n_x=n_y=7$ and a period $a_x=a_y=a$ identical according to the directions x and y. However, it is obvious for those skilled in the art that an MPBG structure having numbers $n_x$ and $n_y$ as well as periods $a_x$ and $a_y$ different according to the directions x and y can also be considered within the framework of the present invention.

The antenna as shown in FIG. 1A has been dimensioned to operate at a frequency f0=5.25 GHz. In this case, the number n of rods seen by the radiating element or source 10 placed in the centre of the structure is equal to n=3, whereas the period is equal to 17.5 mm, the metal rods having a diameter of 1 mm and a height h equal to 8×l, l being the height of the wire source, namely the dipole.

Figure 2:
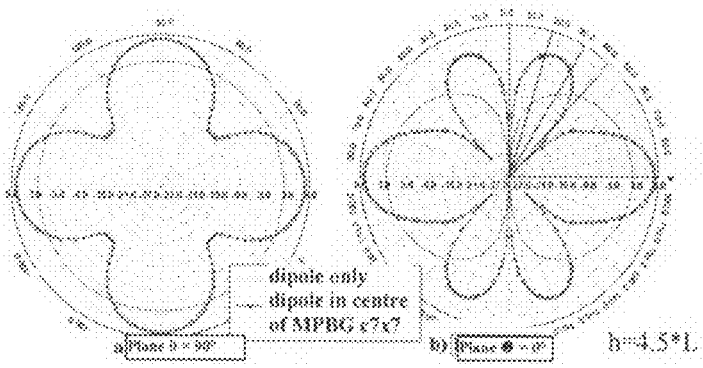
FIG. 2 represents the radiation patterns of a photonic band gap antenna such as shown in FIG. 1 by comparison with the radiation patterns of a single dipole respectively in plane θ=90°(a) and a plane ϕ=0°(b), the height of the metal rods being h=4.5l, where l is the height of the source.

FIG. 1B shows according to the three dimensions, the characteristic surface of the antenna radiation whereas the FIGS. 2A and 2B show, according to a surface cut in the plane θ=90° and the plane ϕ=0, a radiation pattern of the dipole alone and the dipole in the middle of the MPBG structure such as the one in FIG. 1A, but with a height of the metal rods h=4.5*l, where l is the height of the source.

The radiation patterns demonstrate the effect obtained by the MPBG structure on the radiation pattern of an antenna formed by a dipole. Indeed, the presence of a metal PBG structure causes to appear at the working frequency preferred directions of radiation at 0°, 90°, 180° and 270° and radiation minima at 45°, 135°, 225°, 315°.

Figure 3:
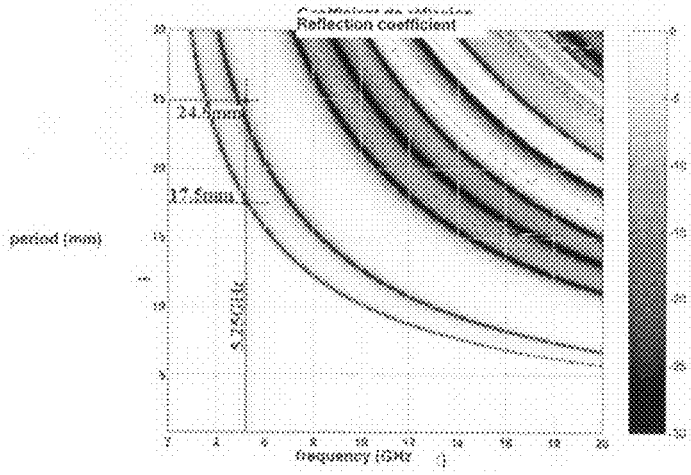
FIG. 3 is a diagram showing the bandwidths and band gaps of a photonic band gap antenna as a function of operating frequency and period.

FIG. 3 shows the pattern of the bands of a metal photonic band gap structure constituted by n=3 metal rods seen from the source according to the period a of the metal PBG. This type of diagram or abacus is used to determine, at the working frequency, the value of the period a that must be used to obtain the radiation required.

Hence, by using the diagram of FIG. 3, it is seen that at a working frequency of f0=5.25 GHz, the period is a=17.5 mm. Consequently, a source placed in the centre of a metal PBG structure formed of 7×7 rods according to a period a=17.5, has according to the directions 0°, 90°, 180°, 270°, a radiation lobe in accordance with the bandwidth character of the band. This has been shown by the radiation patterns of FIGS. 1B and 2.

With reference to FIGS. 4 and 5, a description will now be given of a metal photonic band gap antenna whose structure can improve the radiation patterns of the structure shown in FIG. 1B, more particularly the elevation pattern (plane ϕ=0°). As shown respectively in perspective in FIG. 4A and in a top view in FIG. 4B, the height of the metal rods of FIG. 1A has bee modified such that, from the source, the heights of the rods are increasing.

As will be explained below, the use of the variable height rods enables the elevation radiation pattern to be controlled while retaining the same pattern in the azimuth.

In FIG. 5, a photonic band gap antenna is shown in which the source 10 sees three finite and identical metal rods of height h. In this case, as shown in FIG. 5A, the elevation radiation pattern has several minima due to the passing or blocking behaviour of the photonic band gap structure for the apparent period in the direction considered. This diagram is similar to the diagram of FIG. 2B. Moreover, the 3D radiation pattern shows a radiation lobe according to the z axis. Indeed, when the rods are of constant heights h, the radiation pattern is kept in the plane xOy but changes in the plane xOz as a function of h. In the present case, the pattern of FIG. 1*b* is given for h=8*l (l height of the source) and does not exactly correspond to the 2D representation of FIG. 2 (h=4.5*l).

In accordance with the present invention and as shown in FIG. 5B, the height of the 3 metal rods seen by the source 10 is different from one rod to the other and increasing such that H3<H2<H1. In this case, it will be noticed on the elevation pattern that the secondary lobes due to the behaviour of the metal PBG structure are weaker, which is also seen in the 3D pattern. As mentioned above, the heights H3, H2, H1 can have an increasing monotonic function. Preferably, the height of the rods H3, H2, H1 between the source and the outermost rod (H1) is chosen to be greater than kH1/n, n being equal to the number of rods seen from the source (3 in the embodiment shown), H1 the height of the outer rod and k an integer varying between 1 and n. On the other hand, to obtain the PBG effect, the height H3 must at least be equal to 3×l where l is the height of the radiating source.

Another structure in accordance with the present invention has been shown in part C of FIG. 5. In this case, the source 10 has three metal rods whose height is increasing from the source to the outer rod H'1 where H'3<H'2<H'1. In this embodiment, the size of the metal rods noticeably follows the equation given above. In this case, the elevation pattern of FIG. 5C shows a significant reduction of the secondary lobes due to the particular structure of the metal PBG, which is also seen on the 3D pattern.

The present invention has been described by referring to an antenna in which the source is positioned in the place of a metal rod in the middle of the metal PBG structure. However, it is possible to position the source between the rods. Moreover, the source can be off-centre in the metal photonic band gap structure. The source used in the embodiments described above is a dipole. However, in a practical embodiment, a vertical monopole mounted on a substrate forming a ground plane on which the metal rods of the MPBG structure are also fixed. The number of rods in the direction x can be identical or different from the number of rods in the direction y. Moreover, the periodicity $a_x$ and $a_y$ between the rods according to the directions x or y can be identical, as in the embodiments described, or different.

The invention claimed is:

1. Photonic band gap (PBG) antenna comprising, according to a plane of directions x, y, a radiating source and surrounded by a photonic band gap structure constituted by parallel metal rods, perpendicular to the said plane with rods extending between the radiating source and outermost rod, the rods of diameter d repeating themselves nx times with a period ax in the direction x and ny times with a period ay in the direction y, wherein the height of the rods between the radiating source and the outermost rod is increasing.

2. Antenna according to claim 1, wherein the heights of the rods between the source and the outermost rod is chosen to be greater than k h/n, n being equal to the number of rods seen from the source, h being the height of the outermost rod and k an integer varying between 1 and n.

3. Antenna according to claim 1, wherein the heights of the rods between the source and the outermost rod follow an increasing monotonic function.

4. Antenna according to claim 1, wherein the total numbers $n_x$ and $n_y$ of rods in the directions x and y are identical.

5. Antenna according to claim 1, wherein the number n of rods seen from the source is chosen such that n≧3.

6. Antenna according to claim 1, wherein the periods ax and ay in the directions x and y are identical.

7. Antenna according to claim 1, wherein the rods are produced in a metal material presenting a conductivity greater than $10^{-7}$.

8. Antenna according to claim 7, wherein the material is chosen amongst copper, silver and aluminium.

9. Antenna according to claim 1, wherein the height of the first rod seen from the source is chosen such that H≧3·l where l is the height of the radiating source.

10. Antenna according to claim 1, wherein the source is constituted by a dipole or vertical monopole placed above the substrate.

11. Antenna according to claim 1, wherein the source is positioned in the place of a rod or between the rods.

* * * * *

UNITED STATES PATENT AND TRADEMARK OFFICE

CERTIFICATE OF CORRECTION

PATENT NO. : 7,719,478 B2
APPLICATION NO. : 11/791691
DATED : May 18, 2010
INVENTOR(S) : Nicolas Boisbouvier et al.

It is certified that error appears in the above-identified patent and that said Letters Patent is hereby corrected as shown below:

Title Page, item (54) and Col. 1, lines 1-2, should read;

OPTIMISATION OF FORBIDDEN PHOTON BAND ANTENNAE

Signed and Sealed this
Nineteenth Day of March, 2013

Teresa Stanek Rea
*Acting Director of the United States Patent and Trademark Office*